US012752993B2

(12) United States Patent
Palacios Hernandez

(10) Patent No.: US 12,752,993 B2
(45) Date of Patent: Oct. 6, 2026

(54) ARTICLE CARRIER AND BLANK THEREFOR

(71) Applicant: WestRock Packaging Systems, LLC, Atlanta, GA (US)

(72) Inventor: Juan C. Palacios Hernandez, Cindad de Mexico (MX)

(73) Assignee: WestRock Packaging Systems, LLC, Atlanta, GA (US)

( * ) Notice: Subject to any disclaimer, the term of this patent is extended or adjusted under 35 U.S.C. 154(b) by 423 days.

(21) Appl. No.: 17/797,965

(22) PCT Filed: Feb. 8, 2021

(86) PCT No.: PCT/US2021/017033
§ 371 (c)(1),
(2) Date: Aug. 5, 2022

(87) PCT Pub. No.: WO2021/159055
PCT Pub. Date: Aug. 12, 2021

(65) Prior Publication Data

US 2023/0042155 A1 Feb. 9, 2023

Related U.S. Application Data

(60) Provisional application No. 62/971,390, filed on Feb. 7, 2020.

(51) Int. Cl.
*B65D 71/42* (2006.01)
*B65D 71/00* (2006.01)
*B65D 71/12* (2006.01)

(52) U.S. Cl.
CPC ..... *B65D 71/42* (2013.01); *B65D 71/0085* (2013.01); *B65D 71/125* (2013.01); *B65D 2571/00506* (2013.01)

(58) Field of Classification Search
CPC ..... B65D 2571/00549; B65D 2571/00543; B65D 2571/00512; B65D 71/00;
(Continued)

(56) References Cited

U.S. PATENT DOCUMENTS 3,221,876 A * 12/1965 Currie ..... B65D 71/0085 229/117.26
3,814,304 A * 6/1974 Hester ..... A47G 23/0258 229/117.23
(Continued)

FOREIGN PATENT DOCUMENTS

DE 202004018649 U1 4/2005
JP 08-002551 1/1998
(Continued)

OTHER PUBLICATIONS

JP Office Action dated Sep. 17, 2024, 7 pages.
Korean Office Action dated Sep. 2, 2025, 11 pages.

*Primary Examiner* — Anthony D Stashick
*Assistant Examiner* — Raven Collins
(74) *Attorney, Agent, or Firm* — Rohini K. Garg; Brian J. Goldberg; Tsugihiko Suzuki

(57) ABSTRACT

Aspects of the disclosure relate to an article carrier for packaging one or more articles and a blank for forming the carrier. The article carrier has a plurality of panels including a handle panel and opposed side panels. The opposed side panels are hingedly connected to opposing ends of the handle panel and are disposed about the group of articles on opposing sides thereof. A first side panel is adhered to one of the two or more articles and a second side panel is adhered to another one of the two or more articles to form a package.

20 Claims, 5 Drawing Sheets

(58) Field of Classification Search
CPC ..... B65D 71/50; B65D 71/12; B65D 71/42; B65D 71/0085
See application file for complete search history.

(56) References Cited

U.S. PATENT DOCUMENTS

| | | | | |
|---|---|---|---|---|
| 4,441,611 | A | 4/1984 | Sommariva | |
| 5,323,895 | A | 6/1994 | Sutherland | |
| 5,611,431 | A * | 3/1997 | Harris | B65D 71/16 206/153 |
| 6,202,920 | B1 * | 3/2001 | Auclair | B65D 5/725 229/117.14 |
| 11,142,383 | B2 * | 10/2021 | Thompson | B31B 50/26 |
| 2016/0114919 | A1 | 4/2016 | Johren et al. | |

FOREIGN PATENT DOCUMENTS

| | | | |
|---|---|---|---|
| JP | 2005-153913 | | 6/2005 |
| WO | 1996-21602 | | 7/1996 |
| WO | 1996021602 | A1 | 7/1996 |
| WO | 1997007031 | A2 | 2/1997 |
| WO | 2010014438 | A1 | 2/2010 |
| WO | 2020076781 | A1 | 4/2020 |

* cited by examiner

ARTICLE CARRIER AND BLANK THEREFOR

CROSS REFERENCE TO RELATED APPLICATION

This application claims the benefit of U.S. Provisional Patent Application No. 62/971,390 filed Feb. 7, 2020, the disclosure of which is herein incorporated by reference in its entirety.

TECHNICAL FIELD

The present invention relates to article carriers and to blanks for forming the same. More specifically, but not exclusively, the invention relates to a carrier for providing a carrying handle which is secured to primary product containers.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

The present invention seeks to provide an improvement in the field of cartons, typically formed from paperboard or the like.

SUMMARY

A first aspect of the invention provides a blank for forming an article carrier for packaging at least one article. The blank comprises a handle panel, a first side panel hingedly connected to the handle panel by a first fold line, and a second side panel hingedly connected to the handle panel by a second fold line. The blank comprises a first relief cut formed in the blank. The first relief cut comprises a first portion extending along the first fold line and a second portion that extends in the first side panel at an angle to the first fold line. The blank comprises a second relief cut formed in the blank. The second relief cut comprises a first portion extending along the second fold line and a second portion that extends in the second side panel at an angle to the second fold line.

Optionally, the first side panel comprises adhesive such that the first side panel is configured to be attached to a first article, the second side panel comprises adhesive such that the second side panel is configured to be attached to a second article.

Optionally, the first or second relief cuts comprises a "J" shaped hook at a terminal end thereof.

Optionally, the first or second relief cuts comprise a third portion that extends in one of the first and second side panels at an angle to the first or second fold line respectively.

Optionally, the blank comprises a further relief cut formed in the one of the first and second side panels and extending from a respective one of the first and second fold lines, the further relief cut is disposed between the second portion of one of the first and second relief cuts and the third portion of said one of the first and second relief cuts.

Optionally, each of the first and second relief cuts at least partially defines an opening in a respective one of the first and second side panels, each opening defines an edge in the said respective side panel, and at least one of the edges is disposed in engagement with a portion of the at the at least one article when the handle is in a deployed arrangement.

A second aspect of the invention provides a blank for forming an article carrier for packaging at least one article. The blank comprises a handle panel, a first side panel hingedly connected to the handle panel by a first fold line, and a second side panel hingedly connected to the handle panel by a second fold line. The blank comprises a first relief crease formed in the handle panel and extending from the first fold line at an angle to thereto. The blank comprises a second relief crease formed in the handle panel and extending from the second fold line at an angle to thereto.

Optionally, the at least one first relief crease comprises a first end proximate the first fold line, the first end of the at least one first relief crease is brought into engagement with a portion of the at least one article when the handle is deployed.

Optionally, the at least one second relief crease comprises a first end proximate the second fold line, the first end of the at least one second relief crease is brought into engagement with a portion of the at least one article when the handle is deployed.

Optionally, the at least one first relief crease comprises a pair of relief creases each extending from the first fold line, at an angle to the first fold line, into the handle panel.

Optionally, each of the pair of relief creases is divergently arranged with respect to each other.

Optionally, the at least one first second relief crease comprises a pair of second relief creases each extending from the second fold line, at an angle to the second fold line, into the handle panel.

Optionally, each of the pair of second relief creases is divergently arranged with respect to each other.

A third aspect of the invention provides a blank for forming an article carrier for packaging at least one article. The blank comprises a plurality of panels including a handle panel, a first side panel hingedly connected to the handle panel by a first fold line, and a second side panel hingedly connected to the handle panel by a second fold line. The first side panel comprises adhesive such that the first side panel is configured to be attached to a first article. The second side panel comprises adhesive such that the second side panel is configured to be attached to a second article.

Optionally, the first fold line and the second fold line are substantially parallel to each other.

Optionally, the blank comprises at least one panel for forming an inner ply, said at least one panel being hingedly connected to at least one of the plurality of panels.

A fourth aspect of the invention provides a package including an article carrier and a group of articles comprising two or more articles adhesively secured to each other. The article carrier comprises a plurality of panels including a handle panel and opposed side panels connected to opposing ends of the handle panel. The opposed side panels are disposed about the group of articles on opposing sides thereof. A first side panel is adhered to one of the two or more articles. A second side panel is adhered to another one of the two or more articles.

Optionally, the package comprises at least one article secured to one of the articles to which the article carrier is secured.

Optionally, the opposed side panels comprise a first side panel hingedly connected to the handle panel by a first fold line and a second side panel hingedly connected to the handle panel by a second fold line.

Optionally, the article carrier comprises a first relief cut, the first relief cut comprises a first portion extending along the first fold line and a second portion extending in the first side panel at an angle to the first fold line.

Optionally, the article carrier comprises a second relief cut, the second relief cut comprises a first portion extending along the second fold line and a second portion extending in the second side panel at an angle to the second fold line.

Optionally, the article carrier comprises a first relief crease formed in the handle panel and extending from the first fold line at an angle to the first fold line.

Optionally, the article carrier comprises a second relief crease formed in the handle panel and extending from the second fold line at an angle to the second fold line.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
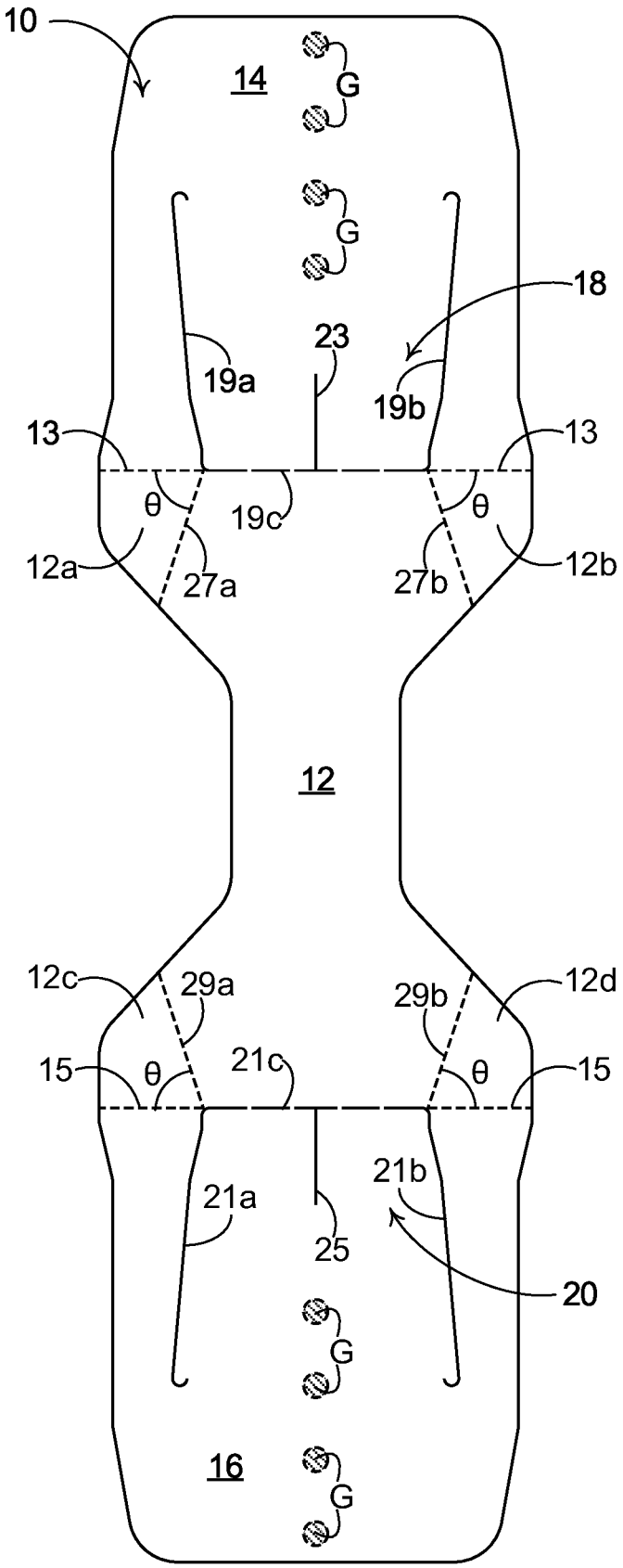
FIG. 1 is a plan view from above of a blank for forming a carrier according to a first embodiment.
Figure 2:
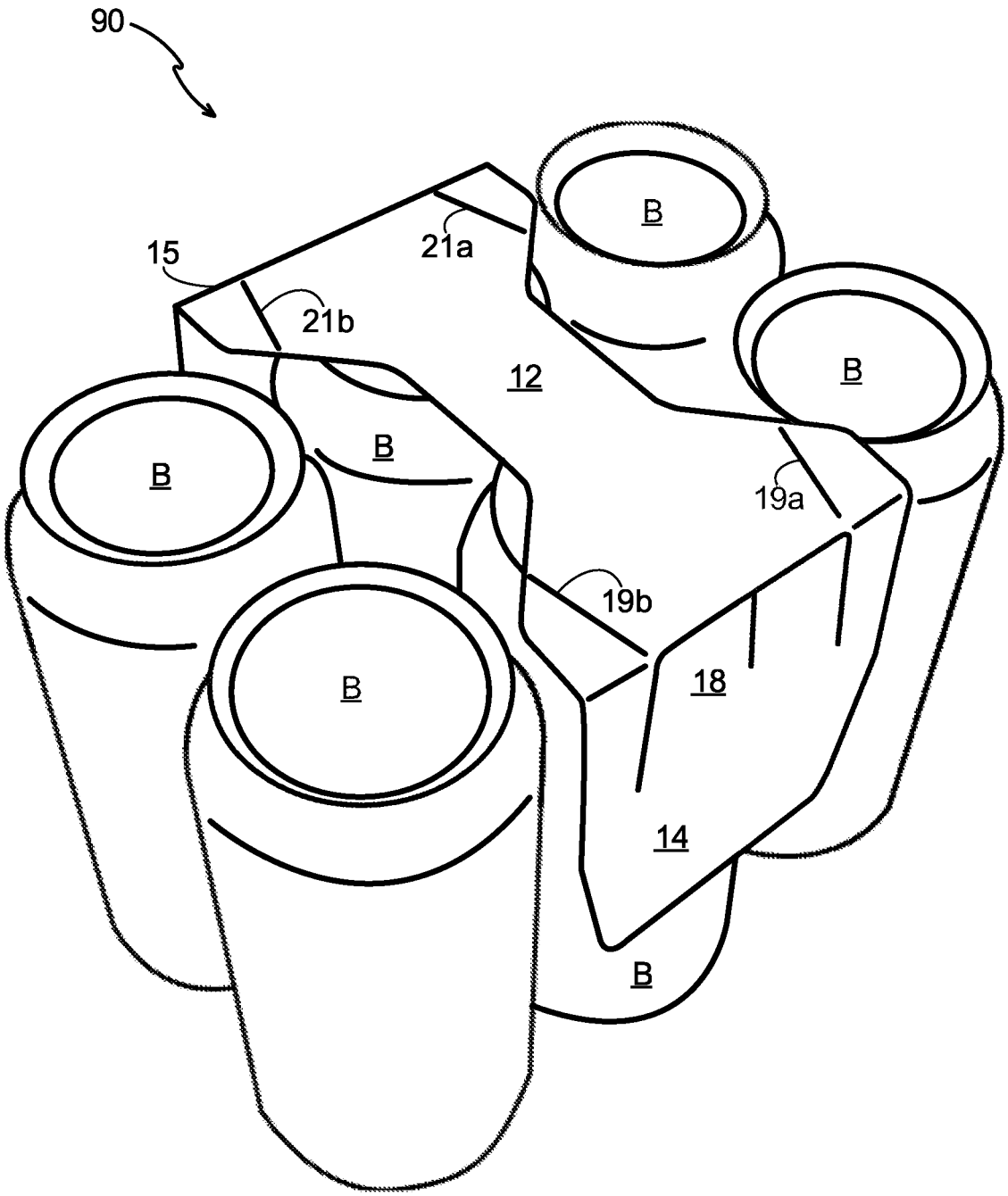
FIG. 2 is a perspective view from above of a carrier formed from the blank of FIG. 1.
Figure 3:
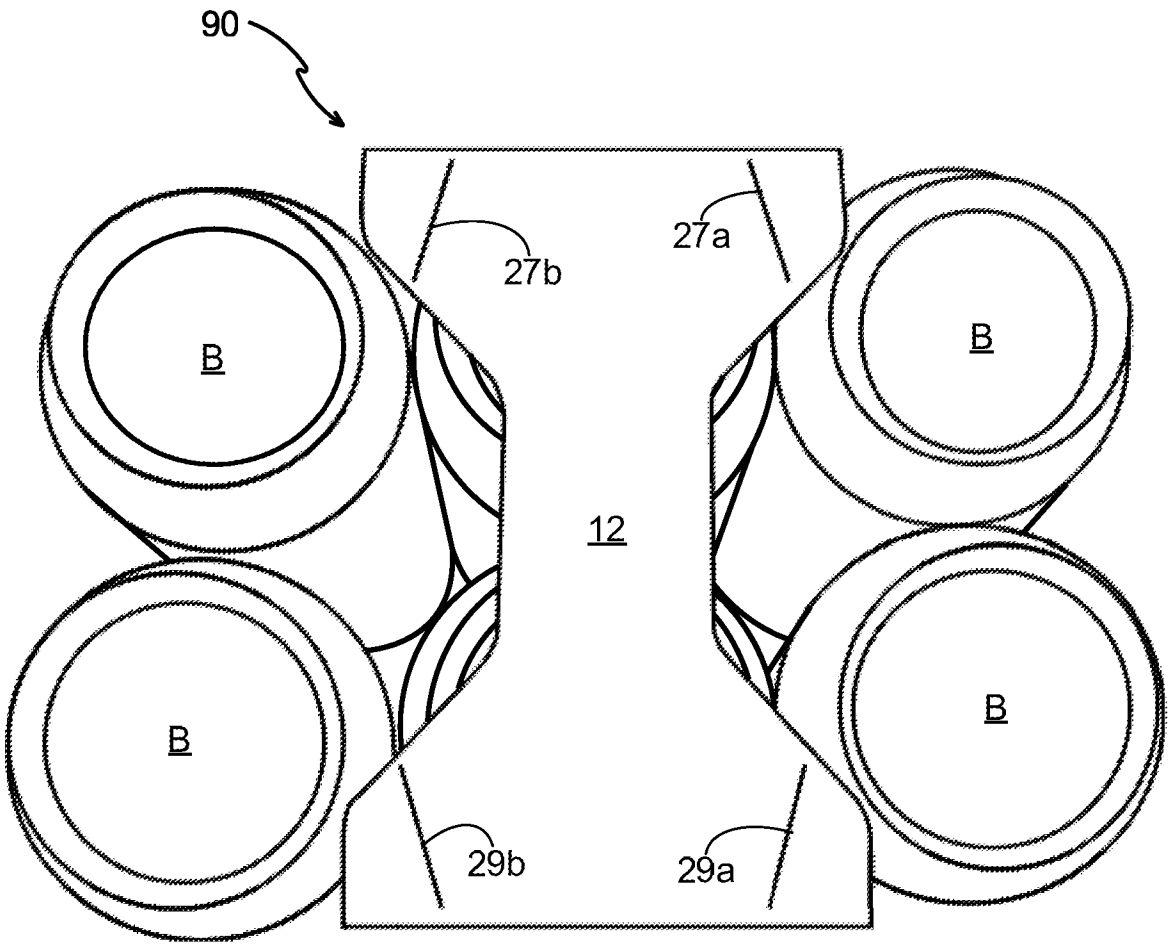
FIG. 3 is a top view of the carrier of FIG. 2.
Figure 4:
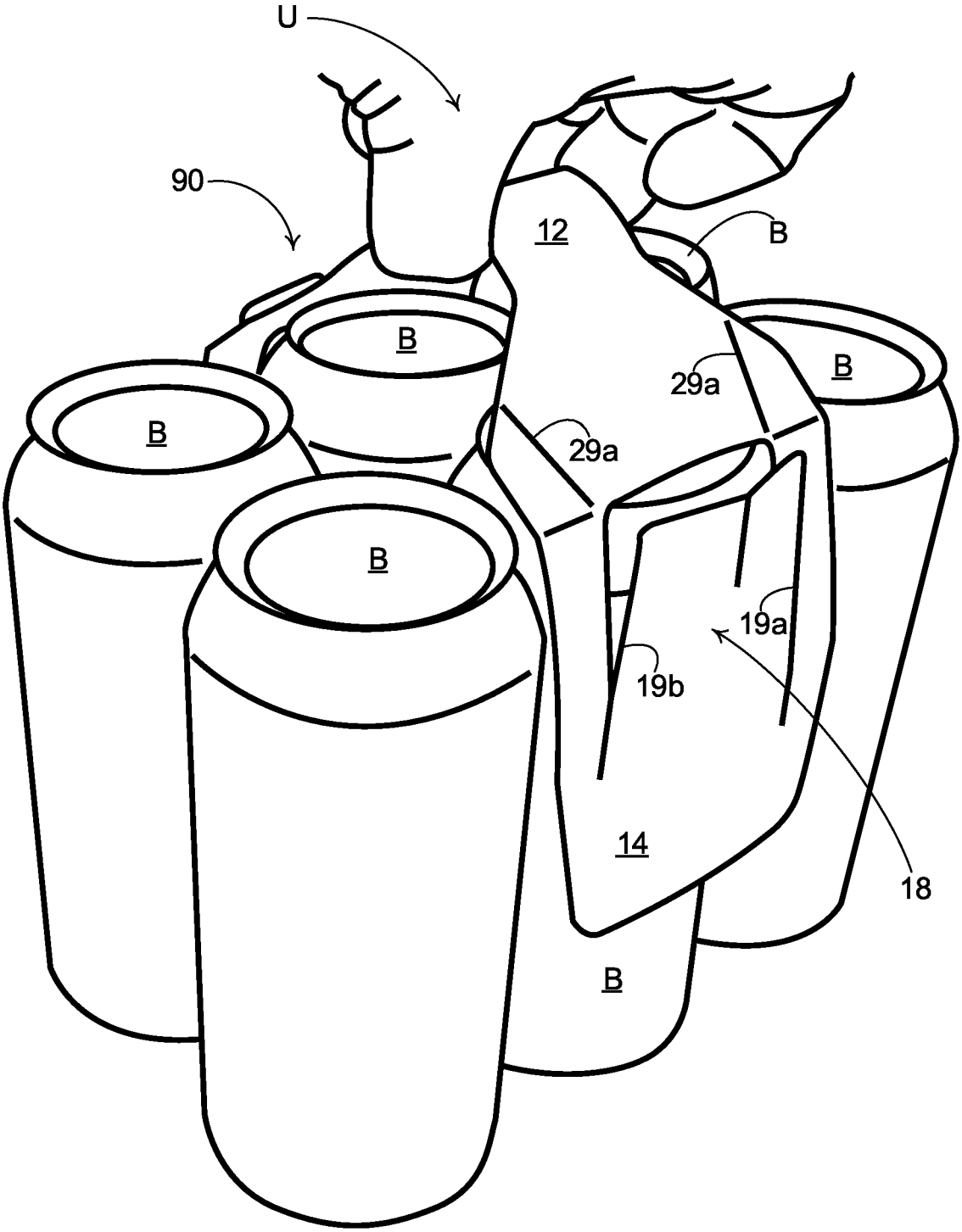
FIG. 4 is a perspective view from above of the carrier of FIG. 2 showing a carrying handle in use.
Figure 5:
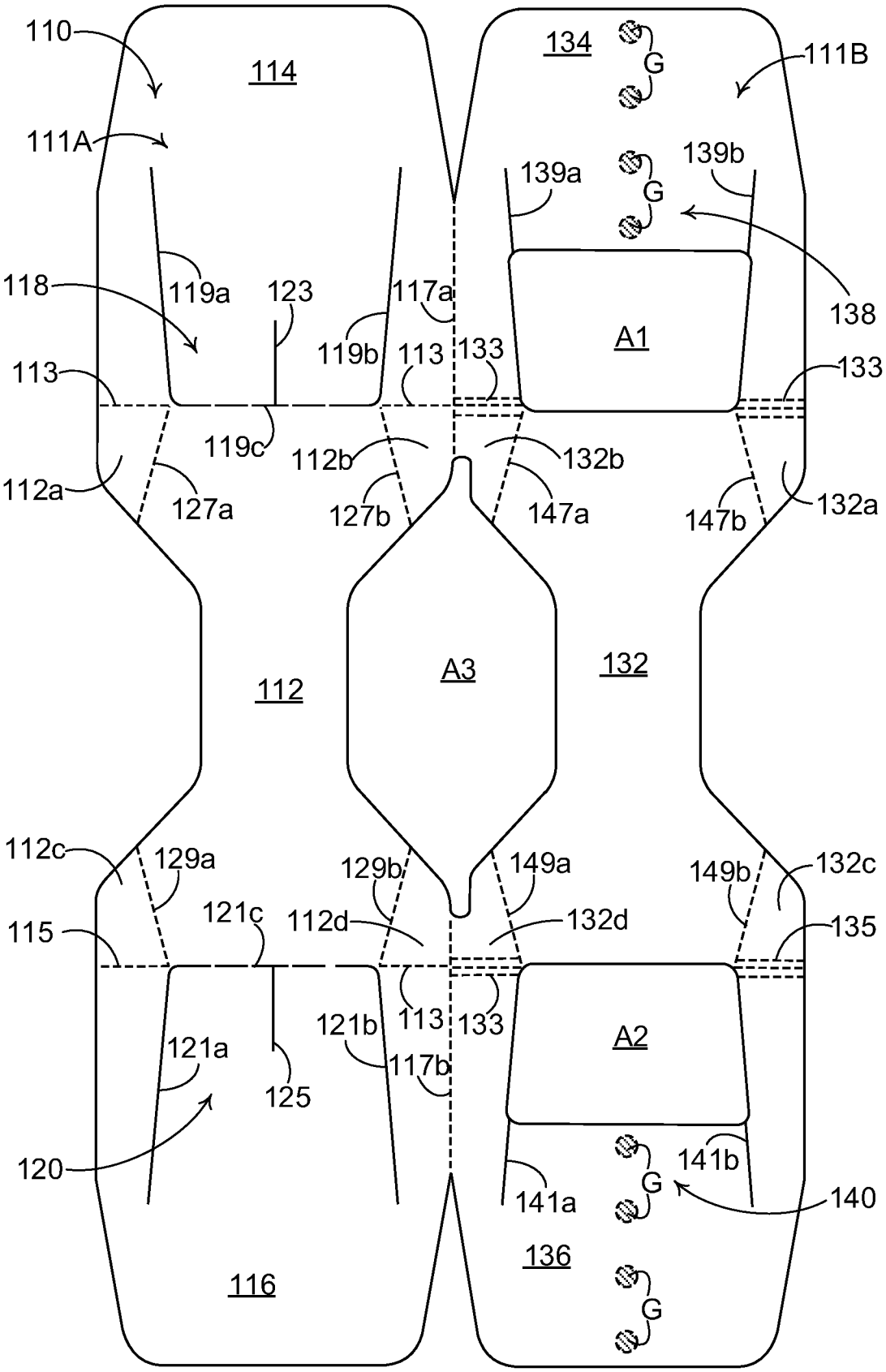
FIG. 5 is a plan view from above of a blank for forming a carrier according to a second embodiment.

Referring to FIG. 1, there is shown a plan view of a blank 10 which is capable of forming a carton or carrier 90, as shown in FIGS. 2, 3 and 4, for carrying a group of primary products such as, but not limited to, bottles or cans, hereinafter referred to as articles B. The blank 10 forms a secondary package for packaging at least one primary product container or package. An alternative blank 110 is shown in FIG. 5 for forming a carton or carrier (not shown).

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blanks 10, 110 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiments, the blanks 10; 110 are configured to form a carton or carrier 90 for packaging an exemplary arrangement of exemplary articles B. In the embodiments illustrated the arrangement is a 3×2 matrix or array; three rows of two articles are provided, and the articles B are beverage cans. Alternatively, the blanks 10; 110 can be configured to form a carrier for packaging other types, number and size of articles and/or for packaging articles in a different arrangement or configuration.

FIG. 1 illustrates a first embodiment and shows a blank 10 for forming a carrier 90 shown in FIGS. 2, 3 and 4. The carrier 90 takes the form of a strap handle; the carrier 90 comprises securing panels 14, 16 secured to a group of articles B.

The blank 10 comprises a main panel 12; the main panel 12 comprises opposed marginal end portions and an intermediate portion disposed therebetween.

The blank 10 comprises a first securing or side panel 14, which may be hingedly connected to the main panel 12 by a hinged connection in the form of a fold line 13.

The blank 10 comprises a second securing or side panel 16, which may be hingedly connected to the main panel 12 by a hinged connection in the form of a fold line 15.

A first marginal end portion of the main panel 12 is hingedly connected to the first side panel 14. The first marginal end portion may be flared or tapered at least in part.

A second marginal end portion of the main panel 12 is hingedly connected to the second side panel 16. The second marginal end portion may be flared or tapered at least in part. In this way the intermediate portion may be narrowed to define a waist. The main panel 12 comprises recesses in each of its opposed side edges. The intermediate portion may provide a grip or handle portion.

In some embodiments the blank 10 may comprise a cushioning flap hinged to the intermediate portion. A cushioning flap may be hingedly connected to opposing side edges of the intermediate portion or grip portion. Each cushioning flap when provided may define a portion of one of the recesses in the side edges of the main panel 12.

The first side panel 14 may comprise a displaceable or relief region 18. The relief region 18 may be disposed centrally or medially in the first side panel 14. The relief region 18 may extend from or terminate at the hinged connection 13 between the first side panel 14 and the main panel 12.

The relief region 18 is defined, at least in part, by a cut or severance line 19*a*/19*b*/19*c*. In other embodiments the relief region 18 may be defined, at least in part, by an alternative cutaway such as but not limited to, an aperture, a slot or slit.

The relief region 18 is defined in part by a first cut line portion 19*a* and a second cut line portion 19*b*. The first cut line portion 19*a* may be divergently arranged with respect to the second cut line portion 19*b*, as illustrated in FIG. 1.

The first and second cut line portions 19*a*, 19*b* each provide a relief cut for relieving stress in the material forming the blank 10.

The first and second cut line portions 19*a*, 19*b* may be coupled together by severable portion 19*c*. The severable portion 19*c* is contiguous with the first and second cut line portions 19*a*, 19*b* and defines a "U" shaped cut. The severable portion 19*c* may be collinear with the fold line 13 hinging the first side panel 14 to the main panel 12.

Each of the first and second cut line portions 19*a*, 19*b* may be terminated with a "J" or "C" shaped cut. The "J" or "C" shaped cut inhibits or reduces the likelihood of a tear propagating from the first and second cut line portions 19*a*, 19*b*.

Optionally, the relief region 18 comprises a fifth relief cut line 23 extending from the severable portion 19*c* between the first and second cut line portions 19*a*, 19*b*. The fifth relief cut line 23 may be shorter in length than the first and second cut line portions 19*a*, 19*b*. The fifth relief cut line 23 is disposed medially in the relief region 18 and may bisect the severable portion 19*c*.

The blank 10 comprises a pair of relief creases in the form of fold lines 27*a*, 27*b*. The fold lines 27*a*, 27*b* extend from the hinged connection between the first side panel 14 and the main panel 12.

The pair of relief creases comprises a first relief crease 27*a* extending from the hinged connection between the first side panel 14 and the main panel 12 into the first marginal end portion of the main panel 12. The first relief crease 27*a* may extend to a first side edge of the main panel 12. The first relief crease 27*a* extends from the hinged connection between the first side panel 14 and the main panel 12 so as to define an angle θ therebetween. The angle θ may be an oblique angle, and may be in the range 20° to 85°. The first relief crease 27*a* may terminate at a tapered edge of the main panel 12.

The first relief crease 27*a* may extend from the fold line 13 proximate an intersection of the first cutline portion 19*a* and the severable portion 19*c*.

The pair of relief creases comprises a second relief crease 27*b* extending from the hinged connection between the first side panel 14 and the main panel 12 into the first marginal end portion of the main panel 12. The second relief crease 27*b* may extend to a second, opposing, side edge of the main panel 12. The second relief crease 27*b* extends from the hinged connection between the first side panel 14 and the main panel 12 so as to define an angle θ therebetween. The angle θ may be an oblique angle, and may be in the range 20° to 85°. The second relief crease 27*b* may terminate at a second, opposing, tapered edge of the main panel 12.

The second relief crease 27*b* may extend from the fold line 13 proximate an intersection of the second cutline portion 19*b* and the severable portion 19*c*.

The second side panel 16 may comprise a second displaceable or relief region 20. The second relief region 20 may be disposed centrally or medially in the second side panel 16. The second relief region 20 may extend from or terminate at the hinged connection 15 between the second side panel 16 and the main panel 12.

The second relief region 20 is defined, at least in part, by a cut or severance line 21*a*/21*b*/21*c*. In other embodiments the second relief region 20 may be defined, at least in part, by an alternative cutaway such as but not limited to, an aperture, a slot or slit.

The second relief region 20 is defined in part by a third cut line portion 21*a* and a fourth cut line portion 21*b*. The third cut line portion 21*a* may be divergently arranged with respect to the fourth cut line portion 21*b*, as illustrated in FIG. 1.

The third and fourth cut line portions 21*a*, 21*b* each provide a relief cut for relieving stress in the material forming the blank 10.

The third and fourth cut line portions 21*a*, 21*b* may be coupled together by second severable portion 21*c*. The second severable portion 21*c* is contiguous with the third and fourth cut line portions 21*a*, 21*b* and defines a "U" shaped cut. The second severable portion 21*c* may be collinear with the fold line 15 hinging the second side panel 16 to the main panel 12.

Each of the third and fourth cut line portions 21*a*, 21*b* may be terminated with a "J" or "C" shaped cut. The "J" or "C" shaped cut inhibits or reduced the likelihood of a tear propagating from the third and fourth cut line portions 21*a*, 21*b*.

Optionally, the second relief region 20 comprises a sixth relief cut line 25 extending from the second severable portion 21*c* between the third and fourth cut line portions 21*a*, 21*b*. The sixth relief cut line 25 is shorter in length than the third and fourth cut line portions 21*a*, 21*b*.

The third relief cut line 23 is disposed medially in the second relief region 20 and may bisect the second severable portion 21*c*.

The blank 10 comprises a pair of second relief creases in the form of second fold lines 29*a*, 29*b*. The second fold lines

29*a*, 29*b* extend from the hinged connection between the second side panel 16 and the main panel 12.

The pair of second relief creases comprises a third relief crease 29*a* extending from the hinged connection between the second side panel 16 and the main panel 12 into the second marginal end portion of the main panel 12. The third relief crease 29*a* may extend to a first side edge of the main panel 12. The third relief crease 29*a* extends from the hinged connection between the second side panel 16 and the main panel 12 so as to define an angle θ therebetween. The angle θ may be an oblique angle, and may be in the range 20° to 85°. The third relief crease 29*a* may terminate at a tapered edge of the main panel 12.

The third relief crease 29*a* may extend from the fold line 15 proximate an intersection of the third cutline portion 21*a* and the second severable portion 21*c*.

The pair of relief creases comprises a fourth relief crease 29*b* extending from the hinged connection between the second side panel 16 and the main panel 12 into the second marginal end portion of the main panel 12. The fourth relief crease 29*b* may extend to a second, opposing, side edge of the main panel 12. The fourth relief crease 29*b* extends from the hinged connection between the second side panel 16 and the main panel 12 so as to define an angle θ therebetween. The angle θ may be an oblique angle, and may be in the range 20° to 85°. The fourth relief crease 29*b* may terminate at a second, opposing, tapered edge of the main panel 12.

The fourth relief crease 29*b* may extend from the fold line 15 proximate an intersection of the fourth cutline portion 21*b* and the second severable portion 21*c*.

The blank 10 is configured to be secured to one or more articles B. The first and second side panels 14, 16 each comprise one or more glue locations G for receiving glue or other adhesive treatment. In the illustrated embodiment four glue locations G are provided in each side panel 14, 16, in other embodiments greater or fewer glue locations may be provided. Inner surfaces of the glue locations of the first and second side panels 14, 16 may be adapted to improve adhesion, for example, but not limited to, omission or removal of varnish or other coatings or finishes which may reduce adhesion, or application of a coating or treatment to improve the adhesive bond.

A fugitive glue may be employed to secure the first and second side panels 14, 16 directly to the articles B. An example of a specific glue is Swift 7044 manufactured by HB Fuller. Use of a fugitive glue is optional. An advantage of a fugitive glue is its tendency to remain attached to the carrier 90 when the articles B are disengaged from the carrier 90, which may be more desirable than having the glue remain attached to the articles B. In alternative embodiments other adhesives may be employed such as, but not limited to, hot-melt glue.

The carrier 90 is shown in FIGS. 2, 3 and 4 in combination with a plurality of articles B forming a package. The package comprises six articles arranged in a 3×2 array, each article B is secured directly to at least one adjacent neighbor. Glue or other adhesive treatment may be employed to secure a first article B to a second article B at a point of contact, or close proximity, between the articles B. Adhesive may be applied to the contact footprint between the first and second articles B, for example a line, strip or plurality of dots or spots of adhesive may be applied to one of the articles B prior to contact with the other.

In the illustrated embodiment each article B is secured to at least two articles B, each article B is adhesively secured at a first location on its perimeter or circumference and at a second location on its perimeter or circumference, the second location being separated from the first by an angle of around 90° or by an angle of around 180°.

The carrier 90 is mounted to the articles B so as to be disposed over the top of and about opposing sides of the group of articles B. When the package is at rest as shown in FIG. 2, cylindrical axes of the articles B are in a generally upright condition.

In the illustrated embodiment, the group of articles B comprises a first pair of endmost articles B at a first end of the group, and a second pair of endmost articles B at a second, opposing, end of the group, a pair of intermediate articles B are disposed between the first and second pairs of endmost articles B.

In the illustrated embodiment the first side panel 14 is secured to one of the intermediate articles B in the group of articles B. The second side panel 16 is secured to the other one of the intermediate articles B in the group of articles B. The pair of intermediate articles B may be adhesively secured to each other.

The first and second pairs of endmost articles B are secured to opposing ends of the intermediate pair of articles B.

The article carrier 90 is secured transversely with respect to the group of articles B; the main panel 12 forms a handle panel extending over the group of articles B, in a transverse direction.

The carrier 90 comprises a relief structure adapted to allow opposing marginal side portions of the side panels 14, 16 to move inwardly when the handle is in use. FIG. 4 illustrates the handle in use, the severable portions 19*c*, 21*c* have been cut, torn or broken to form cuts allowing the marginal side portions of the side panels 14, 16 to be displaced or deformed inwardly. Opposing ends of the handle panel 12 move inwardly, towards each other. This has the effect of allowing the intermediate portion of the handle panel 12 to be displaced, or bowed, upwardly thus creating a space or void thereunder—between the handle panel 12 and the upper ends of the articles B. A user can insert a portion of their hand or fingers into the void to grasp the handle.

The relief creases 27*a*, 27*b*, 29*a*, 29*b* allow or facilitate deformation of the handle panel, adjacent to the marginal side portions of the first and second side panels 14, 16. This may be beneficial to redirect or redistribute load stress or forces in the material forming the carrier 90.

In some embodiments the relief creases 27*a*, 27*b*, 29*a*, 29*b* may direct load forces onto an adjacent intermediate article B. When the handle is in use, an opening is created in the side panels 14, 16, and a portion of the adjacent intermediate article B may extend through said opening, such that edges or corners of the carrier 90 defined by the opening, or parts thereof, may contact the article B. In this way the article B may bear some of the load forces or serve to reinforce, brace or stabilize the handle. This may reduce the load stress or forces exerted upon the adhesive bonds between the carrier 90 and the articles B.

In other embodiments, the article carrier 90 may be secured longitudinally with respect to the group of articles B, rather than being secured to the intermediate articles B, the carrier 90 may be secured to one or both of the first pair of endmost articles B and to one or both of the second pair of endmost articles B. The carrier 90 may comprise a relief structure adapted to allow a medial portion of the side panels to move inwardly when the handle is in use.

Referring now to FIG. 5, there is shown an additional embodiment of the present disclosure. In the second illustrated embodiments like numerals have, where possible, been used to denote like parts, albeit with the addition of the prefix "100" to indicate that these features belong to the second embodiment. The additional embodiment shares many common features with the first embodiment and therefore only the differences from the embodiment illustrated in FIGS. 1 to 4 will be described in detail.

FIG. 5 illustrates a second embodiment and shows a blank 110 for forming a carrier (not shown). The carrier formed from the blank 110 takes the form of a two-ply strap handle.

The blank 110 comprises first series of panels 111A and a second series of panels 111B. The first series of panels 111A is hingedly connected to the second series of panels 111B along fold line 117*a*/117*b*. An aperture A3 is struck from the blank 110 and partially separates the first series of panels 111A from the second series of panels 111B. The aperture A3 interrupts the fold line 117*a*/117*b*, a first portion 117*a* extends form a first end of the aperture A3 and a second portion 117*b* extends from a second opposing end of the aperture A3.

The first series of panels 111A is substantially similar to the blank 10 of FIG. 1. The first series of panels 111A comprises a main panel 112; the main panel 112 comprises opposed marginal end portions and an intermediate portion disposed therebetween.

The blank 110 comprises a first securing or side panel 114 hingedly connected to the main panel 112 by a hinged connection in the form of a fold line 113.

The blank 110 comprises a second securing or side panel 116 hingedly connected to the main panel 112 by a hinged connection in the form of a fold line 115.

A first marginal end portion of the main panel 112 is hingedly connected to the first side panel 114. The first marginal end portion may be flared or tapered at least in part.

A second marginal end portion of the main panel 112 is hingedly connected to the second side panel 116. The second marginal end portion may be flared or tapered at least in part. In this way the intermediate portion may be narrowed to define a waist. The main panel 112 comprises recesses in each of its opposed side edges. The intermediate portion may provide a grip or handle portion.

The first side panel 114 may comprise a displaceable or relief region 118. The relief region 118 may be disposed centrally or medially in the first side panel 114. The relief region 118 may extend from or terminate at the hinged connection 113 between the first side panel 114 and the main panel 112.

The second side panel 116 may comprise a second displaceable or relief region 120. The second relief region 120 may be disposed centrally or medially in the second side panel 116. The second relief region 120 may extend from or terminate at the hinged connection 115 between the second side panel 116 and the main panel 112.

The relief region 118 is defined, at least in part, by a cut or severance line 119*a*/119*b*/119*c*. In other embodiments the relief region 118 may be defined, at least in part, by an alternative cutaway such as but not limited to, an aperture, a slot or slit.

The severance line 119*a*/119*b*/119*c* comprises; a first cut line portion 119*a*, a second cut line portion 119*b*, and a severable portion 119*c*. The severable portion 119*c* is contiguous with the first and second cut line portions 119*a*, 119*b* and defines a "U" shaped cut. The severable portion 119*c* is collinear with the fold line 113 hinging the first side panel 114 to the main panel 112.

The second relief region 120 is defined, at least in part, by a cut or severance line 121*a*/121*b*/121*c*. In other embodiments the second relief region 120 may be defined, at least in part, by an alternative cutaway such as but not limited to, an aperture, a slot or slit.

The severance line 121*a*/121*b*/121*c* comprises; a first cut line portion 121*a*, a second cut line portion 121*b*, and a severable portion 121*c*. The severable portion 121*c* is contiguous with the first and second cut line portions 121*a*, 121*b* and defines a "U" shaped cut. The severable portion 121*c* is collinear with the fold line 115 hinging the second side panel 116 to the main panel 112.

The blank 110 comprises a first pair of relief creases in the form of fold lines 127*a*, 127*b*. The fold lines 127*a*, 127*b* extend from the hinged connection between the first side panel 114 and the main panel 112.

The blank 110 comprises a second pair of relief creases in the form of fold lines 129*a*, 129*b*. The fold lines 129*a*, 129*b* extend from the hinged connection between the second side panel 116 and the main panel 112.

The second series of panels 111B comprises a reinforcing handle or inner top panel 132; the inner top panel 132 comprises opposed marginal end portions and an intermediate portion disposed therebetween.

The blank 110 comprises a first inner side panel 134 hingedly connected to the inner top panel 132 by a hinged connection in the form of a fold line 133. The fold line 133 may comprise a plurality of parallel fold lines, the illustrated embodiment comprises three parallel fold lines.

The blank 110 comprises a second inner side panel 136 hingedly connected to the inner top panel 132 by a hinged connection in the form of a fold line 135. The fold line 135 may comprise a plurality of parallel fold lines, the illustrated embodiment comprises three parallel fold lines.

A first marginal end portion of the inner top panel 132 is hingedly connected to the first inner side panel 134. The first marginal end portion may be flared or tapered at least in part.

A second marginal end portion of the inner top panel 132 is hingedly connected to the second inner side panel 136. The second marginal end portion may be flared or tapered at least in part. In this way the intermediate portion may be narrowed to define a waist. The inner top panel 132 comprises recesses in each of its opposed side edges. The intermediate portion may provide a grip or handle reinforcing portion.

The first inner side panel 134 may comprise a displaceable or inner relief region 138. The relief region 138 may be disposed centrally or medially in the first inner side panel 134.

The inner relief region 138 may extend from, or terminate at, an aperture A1 struck from, or defined within, the first inner side panel 134. The aperture A1 may extend from the hinged connection 133 between the first inner side panel 134 and the inner top panel 132. A first or upper edge of the aperture A1 may interrupt the hinged connection 133 between the first inner side panel 134 and the inner top panel 132. The inner relief region 138 extends from a lower or second opposing edge of the aperture A1. The inner relief region 138 is defined at least in part by a pair of cut lines 139*a*, 139*b*. A first cut line 139*a* extends from the second edge of the aperture A1 proximate or adjacent to a first lower corner of the aperture A1. A second cut line 139*b* extends from the second edge of the aperture A1 proximate or adjacent to a second lower corner of the aperture A1. The first and second cut lines 139*a*, 139*b* may be divergently arranged with respect to each other.

The first cut line 139*a* is arranged to be disposed in registry with a portion of the second cutline portion 119*b* in an assembled condition. The second cut line 139*b* is arranged to be disposed in registry with a portion of the first cutline portion 119*a* in an assembled condition.

The second side panel 136 may comprise a second displaceable or inner relief region 140. The second inner relief region 140 may be disposed centrally or medially in the second inner side panel 136.

The second inner relief region 140 may extend from or terminate at a second aperture A2 struck from, or defined within, the second inner side panel 136. The aperture A2 may extend from the hinged connection 135 between the second inner side panel 136 and the inner top panel 132. A first or upper edge of the second aperture A2 may interrupt the hinged connection 135 between the second inner side panel 136 and the inner top panel 132. The second inner relief region 140 extends from a lower or second opposing edge of the second aperture A2. The second inner relief region 140 is defined at least in part by a pair of cut lines 141*a*, 141*b*. A third cut line 141*a* extends from the second edge of the second aperture A2 proximate or adjacent to a first lower corner of the second aperture A2. A fourth cut line 141*b* extends from the second edge of the second aperture A2 proximate or adjacent to a second lower corner of the second aperture A2. The third and fourth cut lines 141*a*, 141*b* may be divergently arranged with respect to each other.

The third cut line 141*a* is arranged to be disposed in registry with a portion of the fourth cutline portion 121*b* in an assembled condition. The fourth cut line 141*b* is arranged to be disposed in registry with a portion of the third cutline portion 121*a* in an assembled condition.

The blank 110 comprises a third pair of relief creases in the form of fold lines 147*a*, 147*b*. The fold lines 147*a*, 147*b* extend from the hinged connection between the first inner side panel 134 and the inner top panel 132 into the inner top panel 132.

The blank 110 comprises a fourth pair of relief creases in the form of fold lines 149*a*, 149*b*. The fold lines 149*a*, 149*b* extend from the hinged connection between the second inner side panel 136 and the inner top panel 132 into the inner top panel 132.

The blank 110 is formed into a carrier by applying glue or other adhesive treatment to the panels of the first or second series of panels 111A, 111B. The blank 110 is folded about the fold line 117*a*/117*b* to bring the first series of panels 111A into contact with the second series of panels 111B. The first series of panels 111A is secured to the second series of panels 111B.

The blank 110 is configured to be secured to one or more articles B. The first and second inner side panels 134, 136 each comprise one or more glue locations G for receiving glue or other adhesive treatment. Inner surfaces of the glue locations of the first and second inner side panels 134, 136 may be adapted to improve adhesion, for example, but not limited to, omission or removal of varnish or other coatings or finishes which may reduce adhesion, or application of a coating or treatment to improve the adhesive bond.

A fugitive glue may be employed to secure the first and second inner side panels 134, 136 directly to the articles B.

The present disclosure provides a carrier 90 having a main or handle panel 12; 112 and opposed side panels 14, 16; 114, 116 disposed about a group of articles B. The carrier 90 is glued or adhered to one or more of the articles B to form a package.

The articles B may be substantially cylindrical in shape and the carrier 90 is secured to the a first region of a cylindrical wall of a first article B and a second region of a cylindrical wall of a second article B, the first and second regions facing in opposing directions or being diametrically opposed.

The first article B may be in touching contact with the second article B or secured to the second article B by glue or adhesive treatment.

The package may comprise at least one article B secured to only to said one or more of the articles B to which the carrier 90 is secured. The at least one article B is free from connection to the carrier 90 or is unsecured directly to the carrier 90.

The present disclosure provides a blank 10; 110 for forming an article carrier 90 for packaging at least one article B. The blank 10; 110 comprises; a handle panel 12; 112, a first side panel 14; 114 connected to the handle panel 12; 112 by a first fold line 13; 113, and a second side panel 16; 116 connected to the handle panel 12; 112 by a second fold line 15; 115. The blank 10; 110 comprises a first relief cut formed in the blank 10; 110, the first relief cut comprising a first portion 19*c*; 119*c* that extends along the first fold line 13; 113 and a second portion 19*a*; 119*a* that extends in the first side panel 14; 114 at an angle to the first fold line 13; 113. The blank 10; 110 comprises a second relief cut formed in the blank 10; 110, the second relief cut comprising a first portion 21*c*; 121*c* that extends along the second fold line 15; 115 and a second portion 21*a*; 121*a*, that extends in the second side panel 16; 116 at an angle to the second fold line 15; 115.

The first or second relief cuts may have a "J" or "C" shaped hook at a terminal end thereof.

The first or second relief cuts may comprise a third portion 19*b*, 21*b*; 119*b*, 121*b* that extends in one of the first and second side panels 14, 16; 114, 116 at an angle to the first or second fold line 13/15; 113/115 respectively.

The first or second relief cuts define an opening in the first and second side panels respectively, each opening defines an edge in the panels 12, 14, 16; 112, 114, 116 forming the blank 10; 110, said edge being brought into engagement with an edge or surface of the at the at least one article B when the handle is deployed.

The blank 10; 110 may comprise a further relief cut 23, 25; 123, 125 formed in the one of the first and second side panels 14, 16; 114, 116 and extending from the respective one of the first and second fold lines 13/15; 113/115. The further relief cut 23, 25; 123, 125 is disposed between the second portion 19*a*; 119*a*/21*a*, 121*a* of one of the first and second relief cuts and the third portion 19*b*, 119*b*/21*b*; 121*b* of said one of the first and second relief cuts.

The present disclosure provides a blank 10; 110 for forming an article carrier 90 for packaging at least one article B. The blank 10; 110 comprises; a handle panel 12; 112, a first side panel 14; 114 connected to the handle panel 12; 112 by a first fold line 13; 113, and a second side panel 16; 116 connected to the handle panel 12; 112 by a second fold line 15; 115. The blank 10; 110 comprises at least one first relief crease 27*a*, 27*b*; 127*a*, 127*b* formed in the handle panel 12; 112 extending from the first fold line 13; 113 at an angle θ to the first fold line 13; 113. The blank 10; 110 comprises at least one second relief crease 29*a*, 29*b*; 129*a*, 129*b* formed in the handle panel 12; 122 extending from the second fold line 15; 115 at an angle θ to the second fold line 15; 115.

The at least one first relief crease 27*a*, 27*b*; 127*a*, 127*b* comprises a first end proximate the first fold line 13; 113. The first end of at least one first relief crease 27*a*, 27*b*; 127*a*, 127*b* is brought into engagement with an edge or surface of the at the at least one article B when the handle is deployed.

The at least one second relief crease 29*a*, 29*b*; 129*a*, 129*b* comprises a first end proximate the second fold line 15; 115. The first end of at least one second relief crease 29*a*, 29*b*; 129*a*, 129*b* is brought into engagement with an edge or surface of the at the at least one article B when the handle is deployed.

The at least one first relief crease 27*a*, 27*b*; 127*a*, 127*b* comprises a pair of relief creases 27*a*, 27*b*; 127*a*, 127*b* each extending from the first fold line 13; 113 at an angle θ to the first fold line 13; 113 into the handle panel 12; 112. The pair of relief creases 27*a*, 27*b*; 127*a*, 127*b* being divergently arranged with respect to each other.

The at least one first second relief crease 29*a*, 29*b*; 129*a*, 129*b* comprises a pair of relief creases 29*a*, 29*b*; 129*a*, 129*b* each extending from the second fold line 15; 115 at an angle θ to the second fold line 15; 115 into the handle panel 12; 112. The pair of relief creases 29*a*, 29*b*; 129*a*, 129*b* being divergently arranged with respect to each other.

The creases 27*a*, 27*b*, 29*a*, 29*b*; 127*a*, 127*b*, 129*a*, 129*b* may facilitate folding or twisting of the marginal side portions of the first and second side panels 14, 16; 114, 116 about an adjacently disposed article B. Additionally or alternatively, the creases 27*a*, 27*b*, 29*a*, 29*b*; 127*a*, 127*b*, 129*a*, 129*b* may facilitate folding or twisting of wing sections 12*a*, 12*b*, 12*c*, 12*d*; 112*a*, 112*b*, 112*c*, 112*d* of the marginal end portions of the handle panel 12; 112 about an upper portion or neck of an article B disposed adjacent thereto.

The present disclosure provides a blank 10; 110 for forming an article carrier 90 for packaging at least one article B. The blank 10; 110 comprises; a handle panel 12; 112, a first side panel 14; 114 connected to the handle panel 12; 112 by a first fold line 13; 113, and a second side panel 16; 116 connected to the handle panel 12; 112 by a second fold line 15; 115. The first side panel 14; 114 comprises adhesive such that the first side panel 14; 114 is configured to be attached to a first primary container or article B. The second side panel 16; 116 comprises adhesive such that the second side panel 16; 116 is configured to be attached to a second primary container or article B.

The first fold line 13; 113 and the second fold line 15; 115 may be substantially parallel to each other.

It will be recognized that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A blank for forming an article carrier for packaging at least one article, the blank comprising:

a handle panel, a first side panel hingedly connected to the handle panel by a first fold line, and a second side panel hingedly connected to the handle panel by a second fold line, the blank comprising a first relief cut formed in the blank, the first relief cut comprising a first portion extending along a part of the first fold line such that the part is less than an entirety of the first fold line, and a second portion that extends in the first side panel at an angle to the first fold line, wherein a relief region comprises an area defined at least in part by the first portion and the second portion of the first relief cut as boundaries of the relief region, wherein the defined area of the relief region is disposed in a central portion of the first side panel, the blank comprising a second relief cut formed in the blank, the second relief cut comprising a first portion extending along a part of the second fold line such that the part is less than an entirety of the second fold line, and a second portion that extends in the second side panel at an angle to the second fold line.

2. A blank according to claim 1 wherein the first side panel comprises a first adhesive-receiving portion such that the first side panel is configured to be attached to a first side or edge of an object at the first adhesive-receiving portion, the second side panel comprises a second adhesive-receiving portion such that the second side panel is configured to be attached to a second side or edge of an object at the second adhesive-receiving portion.

3. A blank according to claim 1 wherein the first or second relief cuts comprises a "J" shaped hook at a terminal end thereof.

4. A blank according to claim 1 wherein the first and second relief cuts each comprise a third portion that extends in one of the first and second side panels at an angle to a respective one of the first or second fold lines.

5. A blank according to claim 4 wherein the blank comprises a further relief cut formed in the one of the first and second side panels and extending from a respective one of the first and second fold lines, the further relief cut being disposed between the second portion of one of the first and second relief cuts and the third portion of said one of the first and second relief cuts.

6. A blank according to claim 1 wherein each of the first and second relief cuts at least partially define an opening in each of the first and second side panels, respectively, wherein each opening defines an edge in each of the first and second side panels, respectively, at least one of the edges being disposed in engagement with a portion of the at least one article when the handle is in a deployed arrangement.

7. A blank according to claim 1, the blank further comprising: a first relief crease formed in the handle panel and extending from the first fold line at an angle thereto, and a second relief crease formed in the handle panel and extending from the second fold line at an angle thereto.

8. A blank according to claim 7 wherein the first relief crease comprises a first end proximate the first fold line, the first end of the first relief crease is configured to be brought into engagement with a portion of the at least one article when the handle is deployed.

9. A blank according to claim 8 wherein the second relief crease comprises a first end proximate the second fold line, the first end of the second relief crease is configured to be brought into engagement with a portion of the at least one article when the handle is deployed.

10. A blank according to claim 7 wherein the first relief crease comprises a pair of relief creases each extending from the first fold line into the handle panel at an angle to the first fold line.

11. A blank according to claim 10 wherein the second relief crease comprises a pair of second relief creases each extending from the second fold line into the handle panel at an angle to the second fold line.

12. A blank according to claim 11 wherein each of the pair of first relief creases is divergently arranged with respect to each other, and each of the pair of second relief creases is divergently arranged with respect to each other.

13. A blank according to claim 7, wherein the first side panel comprises a first adhesive-receiving portion such that the first side panel is configured to be attached to a first side or edge of an object at the first adhesive-receiving portion, the second side panel comprises a second adhesive-receiving portion such that the second side panel is configured to be attached to a second side or edge of an object at the second adhesive-receiving portion.

14. A package comprising a carrier for carrying one or more objects, the carrier comprising:

a plurality of panels including a handle panel and opposed side panels connected to opposing ends of the handle panel, wherein the handle panel comprises opposed side edges, wherein at least a portion of a first of the side edges comprises a first free outer edge and at least a portion of a second of the side edges comprises a second free outer edge, wherein a first side panel of the opposed side panels comprises a first adhesive-receiving portion such that the first side panel is adhered to one side or edge of one object at the first adhesive-receiving portion and a second side panel of the opposed side panels comprises a second-adhesive receiving portion such that the second side panel is adhered to one side or edge of one object at the second adhesive-receiving portion, wherein the first side panel is hingedly connected to the handle panel by a first fold line and the second side panel is hingedly connected to the handle panel by a second fold line, wherein the carrier further comprises a first relief crease formed in the handle panel and extending from the first fold line at an angle with respect to the first fold line; and a second relief crease formed in the handle panel and extending from the second fold line at an angle with respect to the second fold line.

15. A package according to claim 14 comprising at least one additional object secured to the one object to which at least one of the opposed side panels is adhered.

16. A package according to claim 15 wherein the carrier comprises a first relief cut, the first relief cut comprising a first portion extending along the first fold line and a second portion extending in the first side panel at an angle with respect to the first fold line; and a second relief cut, the second relief cut comprising a first portion extending along the second fold line and a second portion extending in the second side panel at an angle with respect to the second fold line.

17. A blank according to claim 1 wherein the first fold line and the second fold line are substantially parallel to each other.

18. A blank according to claim 1 comprising at least one inner panel for forming an inner ply with respect to at least one of the handle panel, the first side panel, and the second side panel, wherein the at least one inner panel is hingedly connected to at least one of the handle panel, the first side panel, and the second side panel.

19. A blank for forming an article carrier for packaging at least one article, the blank comprising:

a handle panel, a first side panel hingedly connected to the handle panel by a first fold line, and a second side panel hingedly connected to the handle panel by a second fold line, the blank comprising a first relief cut formed in the blank, the first relief cut comprising a first portion extending along a part of the first fold line such that the part is less than an entirety of the first fold line, and a second portion that extends in the first side panel at an angle to the first fold line, and the blank comprising a first relief crease formed in the blank disposed to extend obliquely with respect to the first fold line from a point proximate a convergence of the first fold line with the second portion of the first relief cut.

20. A blank according to claim 19, the blank further comprising a second relief cut formed in the blank, the second relief cut comprising a first portion extending along a part of the second fold line such that the part is less than an entirety of the second fold line, and a second portion that extends in the second side panel at an angle to the second fold line, and the blank comprising a second relief crease formed in the blank disposed to extend obliquely with respect to the second fold line from a point proximate a convergence of the second fold line with the second portion of the second relief cut.

* * * * *